US011920269B2

(12) United States Patent
Klopfenstein

(10) Patent No.: US 11,920,269 B2
(45) Date of Patent: Mar. 5, 2024

(54) TEMPLATE CLAMPING APPARATUS

(71) Applicant: Jack Klopfenstein, Brodhead, WI (US)

(72) Inventor: Jack Klopfenstein, Brodhead, WI (US)

( * ) Notice: Subject to any disclaimer, the term of this patent is extended or adjusted under 35 U.S.C. 154(b) by 0 days.

(21) Appl. No.: 17/699,379

(22) Filed: Mar. 21, 2022

(65) Prior Publication Data

US 2023/0295850 A1 Sep. 21, 2023

(51) Int. Cl.
*D05B 11/00* (2006.01)
*D05B 39/00* (2006.01)

(52) U.S. Cl.
CPC ..... *D05B 11/00* (2013.01); *D05B 39/00* (2013.01)

(58) Field of Classification Search
CPC ..... D05B 11/00; D05B 11/005; D05B 39/00; D05B 39/005; D05B 35/10; D05B 35/107
See application file for complete search history.

(56) References Cited

U.S. PATENT DOCUMENTS 1,788,417 A * 1/1931 Weis ..... D05B 21/007 112/470.17
2,145,060 A * 1/1939 Stroop ..... D05B 11/00 112/303
4,646,666 A * 3/1987 Burrier ..... B44C 3/12 112/475.08
4,685,408 A * 8/1987 Frye ..... D05B 21/00 112/288
5,024,174 A * 6/1991 Ferguson ..... B60R 21/235 112/14
5,557,996 A * 9/1996 Reber ..... B26B 29/06 30/292
5,647,292 A * 7/1997 Morgulis ..... D05B 21/007 112/10
5,860,375 A * 1/1999 Williams ..... D05C 1/02 38/102.2
6,321,457 B1 * 11/2001 Lariviere, Jr. ..... B26B 29/06 33/562

* cited by examiner

*Primary Examiner* — Ismael Izaguirre
(74) *Attorney, Agent, or Firm* — David J. Archer

(57) ABSTRACT

A template clamping apparatus is disclosed for clamping a fabric against a quilt making template. The apparatus includes a base which has an upper surface and a lower surface. A turntable is supported by the base, the turntable defining a working surface which is rotatable relative to the base. An arm is rigidly connected to the base, the arm having a first and a second end. A clamp is connected to the second end of the arm such that when the clamp is disposed in a loading disposition thereof, loading of the fabric between the quilt making template and the turntable is permitted. However, when the clamp is disposed in a clamping disposition thereof, the fabric is clamped between the quilt making template and the turntable. The arrangement is such that relative movement between the quilt making template and the fabric is inhibited while permitting the fabric sandwiched between the turntable and the quilt making template to rotate relative to the base so that cutting of the fabric in conformity with the quilt making template is facilitated.

15 Claims, 7 Drawing Sheets

TEMPLATE CLAMPING APPARATUS

BACKGROUND OF THE INVENTION

Field of the Invention

The present invention relates to a template clamping apparatus.

More specifically, the present invention relates to a template clamping apparatus for clamping a fabric against a quilt making template.

Background Information

The art of making a hand-made quilt for covering a bed or the like requires much skill and patience and is labor intensive. However, the end product is often a work of art that is completely unique in both appearance and texture.

Basically, a quilt is made up of a mosaic of small pieces of fabric or cloth material. These small pieces of cloth material are cut from various rolls of material and are then sewn together to make the quilt. The small pieces of cloth which may for example be about 4 inches by 4 inches may all be of the same shape such as a square. Alternatively, these pieces may be of various shapes such as a rectangles, triangles or other shapes. However, the periphery of each piece of cloth must usually consist of at least three straight sides. Each straight side is sewn to an adjacent straight side of another piece of material. This stitching is along a line approximately one quarter of an inch away from and parallel to the straight sides of an adjacent piece. Usually, a template is pressed against the material to hold the material so that the piece of material can be accurately cut around the outer edges of the template by a hand-held rotary cutter. The quilt template is made from a translucent material such as Perspex or the like. For example, a triangular quilt template will be used for cutting a piece of fabric having three straight sides. Additionally, the template will typically include a dashed line imprinted one quarter inch inbound relative to the periphery of the template to indicate to the quilt maker that the adjacent sides of the pieces to be sewn together must be sewn one quarter inch from the respective and adjacent straight sides.

The art of quilt making requires great skill and often the materials used for cutting out quilt pieces are very costly. However, although quilt making is costly and time consuming, the resultant quilt product may become a work of art with each resultant quilt being completely unique.

Nevertheless, the use of various quilt templates for firmly holding down the material during cutting has proved to be difficult. More particularly, when trying to press the template against the material with one hand and trying to accurately cut the material around the template with the other hand, slippage of the material relative to the template can occurs. Such slippage of the material will cause the piece of material to be cut inaccurately. Consequently, such faulty pieces must often be discarded.

The present invention provides a unique apparatus for firmly pressing and holding the quilt template against the material. The apparatus of the present invention also allows several layers of the stacked material to be cut along the peripheral edges of the quilt template at the same time.

SUMMARY OF THE INVENTION

The present invention relates to a template clamping apparatus for clamping a fabric against a quilt making template. The apparatus includes a base which has an upper surface and a lower surface. A turntable is supported by the base, the turntable defining a working surface which is rotatable relative to the base. An arm is rigidly connected to the base, the arm having a first and a second end. A clamp is connected to the second end of the arm such that when the clamp is disposed in a loading disposition thereof, loading of the fabric between the quilt making template and the turntable is permitted. However, when the clamp is disposed in a clamping disposition thereof, the fabric is clamped between the quilt making template and the turntable. The arrangement is such that when the clamp is disposed in the clamping disposition, relative movement between the quilt making template and the fabric is inhibited. At the same time, the apparatus enables the fabric sandwiched between the turntable and the quilt making template to rotate relative to the base so that cutting of the fabric in conformity with the quilt making template is facilitated.

In a more specific embodiment of the present invention, the base is cut from a rigid sheet of material and the sheet of material is fabricated from a plastics material.

Also, the base includes a plurality of spaced support legs.

Moreover, the turntable includes a first portion which defines a plurality of spaced recesses. A plurality of ball bearings is arranged such that a ball bearing of the plurality of ball bearings is disposed within each of the spaced recesses.

Additionally, a second portion of the turntable defines at least one concentric track such that each one of the ball bearings cooperates with the at least one concentric track such that relative rotation between the first portion and the second portion of the turntable is permitted.

In this manner, the turntable is bearingly supported for rotation relative to the base.

Also, the first end of the arm is rigidly anchored to the base. A brace has a first and a second extremity, with the first extremity of the brace being rigidly secured to the base. The second extremity of the brace is rigidly secured to the arm between the first end and the second end of the arm.

The arm includes a first part which extends upwardly from the base. A second part of the arm extends from the first part, the second part extending horizontally and spaced relative to the base.

A block is connected to the second end of the arm, the block defining a bore.

Additionally, a lever is connected to the block, the lever having a first extremity and a second extremity.

Moreover, the clamp includes a rod which slidably cooperates with the bore of the block, the rod having a proximal end and a distal end.

The first extremity of the lever is pivotally connected to the proximal end of the rod. A link has a first end and a second end. The lever is pivoted between the first extremity of the lever and the second extremity of the lever to the first end of the link. The second end of the link is pivoted to the block. The arrangement is such that when the lever is disposed in a first location thereof, the clamp is disposed in the loading disposition and when the lever is disposed in a second location thereof, the clamp 34 is disposed in the clamping disposition.

Also, an anchor is rigidly secured to the second end of the arm for adjustably securing the block relative to the second end of the arm.

Furthermore, the clamp further includes a coupling which is secured to the distal end of the rod. The coupling defines a recess.

Additionally, a bearing cooperates with and is at least partially disposed within the recess of the coupling.

Further, a template holder is supported by the bearing such that relative rotation between the template holder and the distal end of the rod is permitted. The arrangement is such that when the clamp is in the clamping disposition thereof, rotation of the turntable rotates the fabric, the template and the template holder to facilitate cutting the fabric along a pattern defined by the template.

More particularly, the template holder includes a suction pad.

Also, a cutting sheet is disposed between the fabric and the turntable for protecting the turntable during cutting of the fabric.

Therefore, a primary object of the present invention is the provision of a template clamping apparatus for clamping a fabric against a quilt making template.

Another objective of the present invention is the provision of a template clamping apparatus for clamping a fabric against a quilt making template that facilitates cutting of the fabric.

Yet another object of the present invention is the provision of a template clamping apparatus for clamping a fabric against a quilt making template that reduces the possibly of fabric wastage due to incorrect cutting of the fabric.

A further object of the present invention is the provision of a template clamping apparatus for clamping a fabric against a quilt making template that prevents any slippage of the fabric relative to the template thus reducing the possibly of fabric wastage of the fabric.

Another object of the present invention is the provision of a template clamping apparatus for clamping a fabric against a quilt making template that increases the rate of production of the number of pieces cut from the material.

Other features and advantages of the present invention will be readily apparent to those skilled in the art by a consideration of the detailed description of a preferred embodiment of the present invention contained herein.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
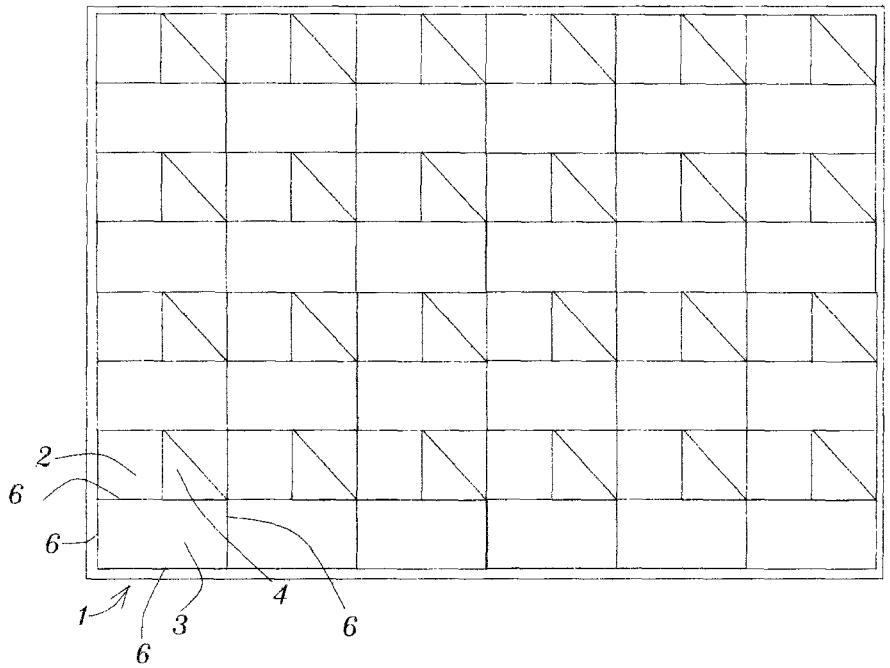
FIG. 1 is a top plan view of a typical quilt.

FIG. 1 is a top plan view of a typical quilt generally designated 1. As shown in FIG. 1, the quilt 1 is made up of a mosaic of small pieces of fabric or cloth such as pieces 2, 3 and 4. These pieces of cloth material 2 to 4 are cut out of various types of material and may be a square 2, rectangle 3 or a triangle 4 or another shape. For example, piece 3 is of rectangular shape and consists of four straight sides each numbered 6. The top straight side 6 of such piece of material 3 is sewn to an adjacent bottom straight side 6 of another piece of material such as the square 2. The stitching line for stitching piece 2 to piece 3 is straight and is disposed approximately one quarter of an inch away from and parallel to these straight sides 6 of the pieces 2 and 3.

Figure 2:
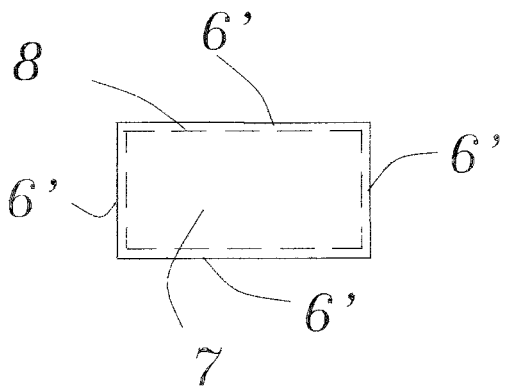
FIG. 2 is a top plan view of a typical quilt template.

FIG. 2 is a top plan view of a typical quilt template 7. As shown in FIG. 2, the template 7 is used for cutting out the rectangular piece of material or fabric 3 shown in FIG. 1. Consequently, the template has four straight edges each referenced 6'. The quilt template 7 is usually made from a translucent material such as Perspex or the like. Additionally, the template 7 will typically include a dashed line 8 imprinted one quarter inch inbound relative to the straight edges 6' to assist the quilt maker to sew piece 2 to piece 3 one quarter inch from the respective and adjacent straight sides 6.

The art of quilt making requires much skill and the rolls of materials from which quilt pieces are cut can be very costly. However, although quilt making is expensive and time consuming, the end product may turn out to be a work of art with each resultant quilt being completely unique.

Nevertheless, the use of various quilt templates for pressing and firmly holding down the material during cutting has proved to be difficult. More particularly, slippage of the material relative to the template may occur when attempting to hold down the template with one hand and cutting around the template with the other hand. If slippage occurs, the pieces that are cut are not of the required shape and must be discarded. The present invention provides a unique apparatus that firmly presses and holds the quilt template against the material or even several layers of the material while it is cut along the edges of the quilt template.

Figure 3:
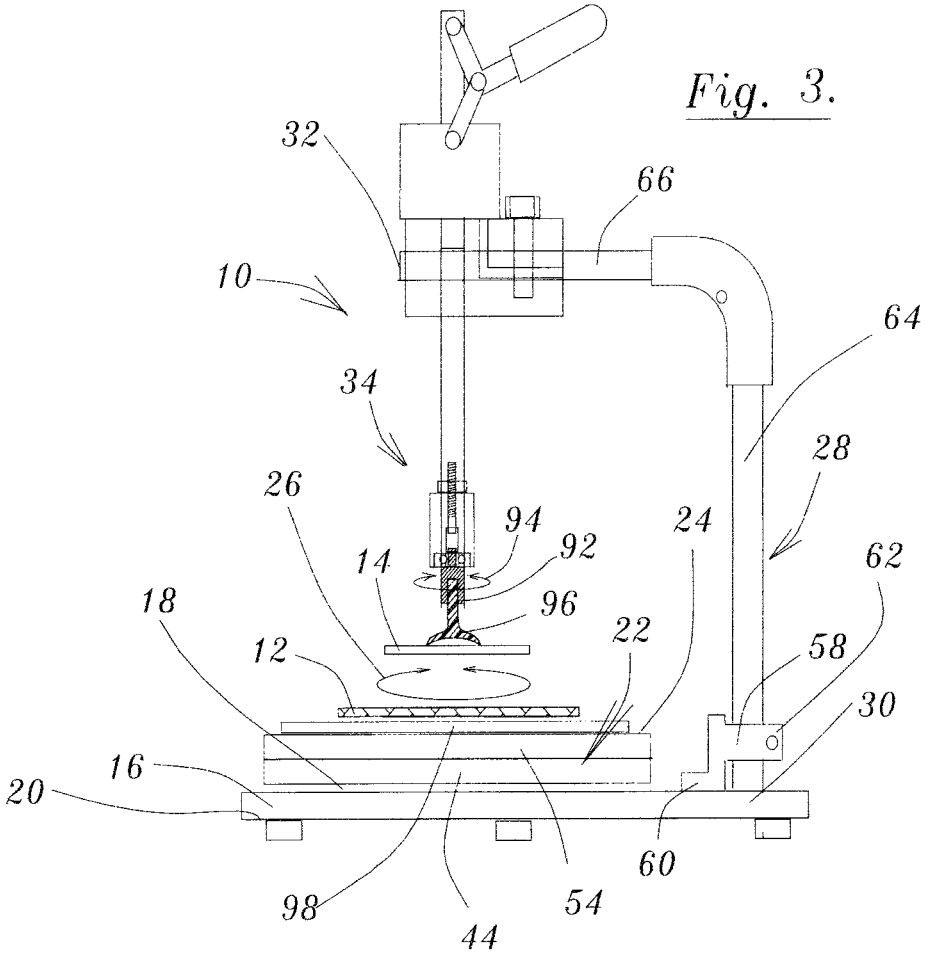
FIG. 3 is a side elevational view of a template clamping apparatus according to the present invention.

FIG. 3 is a side elevational view of a template clamping apparatus generally designated 10 according to the present invention. As shown in FIG. 3, the template clamping apparatus 10 is used for clamping a fabric 12 against a quilt making template 14. The apparatus 10 includes a base 16 which has an upper surface 18 and a lower surface 20. A turntable generally designated 22 is supported by the base 16, the turntable 22 defining a working surface 24 which is rotatable relative to the base 16 as indicated by the arrow 26. An arm generally designated 28 is rigidly connected to the base 16, the arm 28 having a first end 30 and a second end 32. A clamp generally designated 34 is connected to the second end 32 of the arm 28. The arrangement is such that when the clamp 34 is disposed in a loading disposition thereof as shown in FIG. 3, loading of the fabric 12 between the quilt making template 14 and the turntable 22 is permitted.

Figure 4:
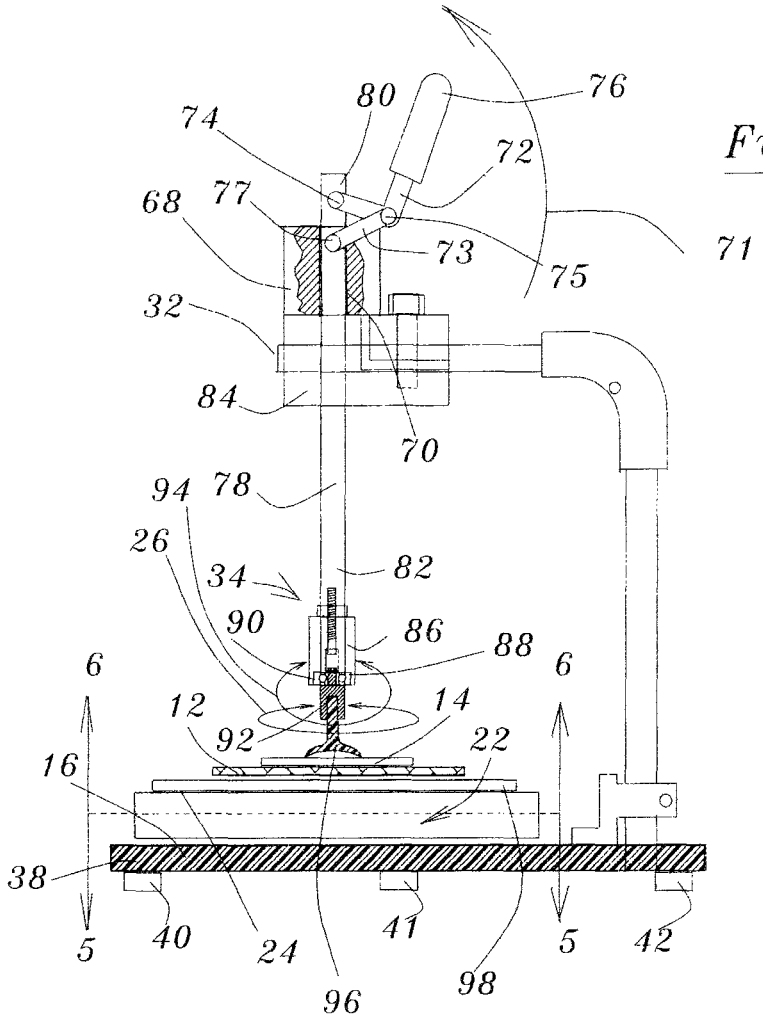
FIG. 4 is a similar view to that shown in FIG. 3 but shows the clamp disposed in a clamping disposition thereof.

FIG. 4 is a similar view to that shown in FIG. 3 but shows the clamp 34 disposed in a clamping disposition thereof. As shown in FIG. 4, the fabric 12 is clamped between the quilt making template 14 and the turntable 22. The arrangement is such that in the clamping disposition shown in FIG. 4, relative movement between the quilt making template 14 and the fabric 12 is inhibited while permitting the fabric 12 sandwiched between the turntable 22 and the quilt making template 14 to rotate as indicated by the arrow 26 relative to the base 16 so that cutting of the fabric 12 by a hand held rotary cutter (not shown) in conformity with the quilt making template 14 is facilitated.

In a more specific embodiment of the present invention, the base 16 is cut from a rigid sheet of material 38. The sheet of material 38 is fabricated from a plastics material.

Also, the base 16 includes a plurality of spaced support legs 40, 41 and 42.

Figure 5:
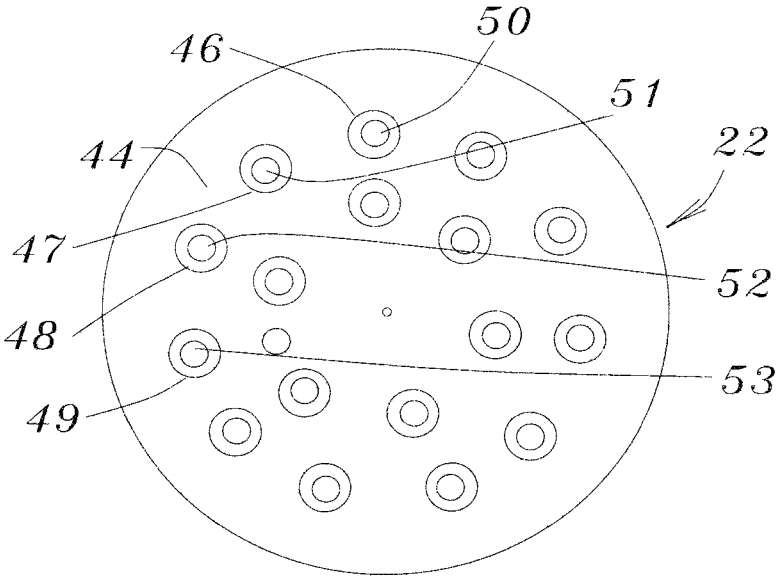
FIG. 5 is a view taken on the line 5-5 shown in FIG. 4.

FIG. 5 is a view taken on the line 5-5 shown in FIG. 4. As shown in FIG. 5, the turntable 22 includes a first portion 44 which defines a plurality of spaced recesses such as recesses 46, 47, 48 and 49. A plurality of ball bearings 50, 51, 52 and 53 is arranged such that each one of the ball bearings of the plurality of ball bearings 50 to 53 is disposed within a respective recess of the plurality of spaced recesses 46 to 49.

Figure 6:
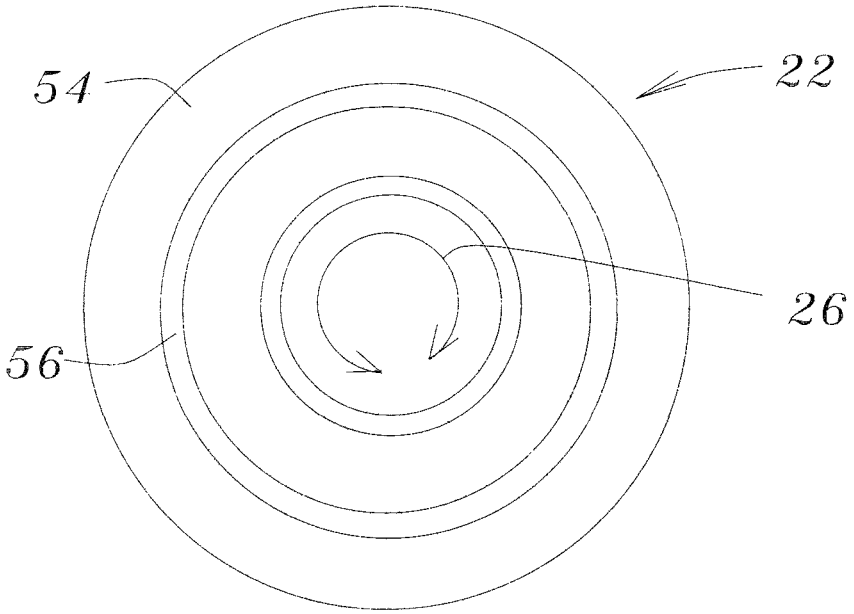
FIG. 6 is a view taken on the line 6-6 shown in FIG. 4.

FIG. 6 is a view taken on the line 6-6 shown in FIG. 4. As shown in FIG. 6, a second portion 54 of the turntable 22 defines at least one concentric track 56 such that each one of the ball bearings such as ball bearing 50 shown in FIG. 5, cooperates with the at least one concentric track 56 such that relative rotation as indicated by arrow 26 between the first portion 44 shown in FIG. 5 and the second portion 54 shown in FIG. 6 is permitted.

In this way, the turntable 22 is bearingly supported for rotation relative to the base 16 as indicated by the arrow 26.

As shown in FIG. 3, the first end 30 of the arm 28 is rigidly anchored to the base 16. A brace 58 has a first extremity 60 and a second extremity 62, with the first extremity 60 of the brace 58 being rigidly secured to the base 16. The second extremity 62 of the brace 58 is rigidly secured to the arm 28 between the first end 30 and the second end 32 of the arm 28.

The arm 28 includes a first part 64 which extends upwardly from the base 16. A second part 66 of the arm 28 extends from the first part 64, the second part 66 extending horizontally and spaced relative to the base 16.

As shown in FIG. 4, a block 68 is connected to the second end 32 of the arm 28, the block 68 defining a bore 70. Additionally, a lever 72 is connected to the block 68, the lever 72 having a first extremity 74 and a second extremity 76.

Moreover, the clamp 34 includes a rod 78 which slidably cooperates with the bore 70 of the block 68, the rod 78 having a proximal end 80 and a distal end 82.

The first extremity 74 of the lever 72 is pivotally connected to the proximal end 80 of the rod 78. A link 73 has a first end 75 and a second end 77. The lever 72 is pivotally connected to the first end 75 of the link 73 between the first extremity 74 of the lever 72 and the second extremity 76 of the lever 72. The second end 77 of the link 73 is pivotally connected to the block 68. The arrangement is such that when the lever 72 is disposed in a first location thereof as shown in FIG. 3, the clamp 34 is disposed in the loading disposition, When the lever 72 is rotated as indicated by the arrow 71 shown in FIG. 4, the disposed in a second location thereof as shown in FIG. 4, the clamp 34 is disposed in the clamping disposition.

As shown in FIG. 4, an anchor 84 is rigidly secured to the second end 32 of the arm 28 for adjustably securing the block 68 relative to the second end 32 of the arm 28.

Furthermore, the clamp 34 further includes a coupling 86 which is secured to the distal end 82 of the rod 78. The coupling 86 defines a recess 88.

Additionally, a bearing 90 cooperates with and is at least partially disposed within the recess 88 of the coupling 86.

As shown in FIG. 3, a template holder 92 is supported by the bearing 90 such that relative rotation between the template holder 92 and the distal end 82 of the rod 78 is permitted as indicated by the arrow 94. The arrangement is such that when the clamp 34 is in the clamping disposition thereof as shown in FIG. 4, rotation of the turntable 22 as indicated by the arrow 26 rotates the fabric 12, the template 14 and the template holder 92 as indicated by the arrow 94 to facilitate cutting the fabric 12 along a pattern defined by the template 14.

More particularly, the template holder 92 includes a suction pad 96.

Also, a cutting sheet 98 is disposed between the fabric 12 and the turntable 22 for protecting the working surface 24 turntable 22 during cutting of the fabric 12.

Figure 7:
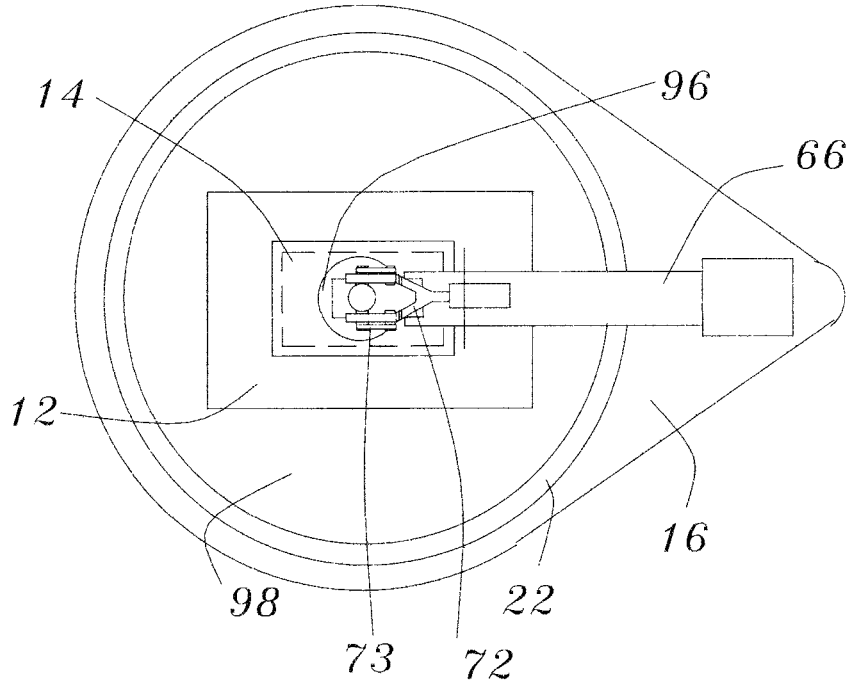
FIG. 7 is a top plan view of the apparatus shown in FIG. 3.

FIG. 7 is a top plan view of the apparatus 10 and shows the fabric 12 and the template 14. The suction pad 96 is also shown and the lever 72 and link 73.

In operation of the template clamping apparatus 10, the fabric 12 is placed on the cutting sheet 98 as shown in FIG. 3. The lever 72 is rotated as indicated by the arrow 71 shown in FIG. 4 so that the clamp 34 is in the clamping disposition as shown in FIG. 4. During rotation of the lever 72, the rod 78 and suction pad 96 descend towards the upper surface of the template 14 such that the fabric 12 is firmly pressed against the cutting sheet 98 and turntable 22. The quilt maker is then able to carefully cut out the piece of material by cutting along one of the straight edges 6' of the template 14. The turntable 22 is then rotated slightly in order to facilitate cutting along the next straight edge 6' of the template 14. As the turntable 22, fabric 12 and template 14 move in unison as indicated by the arrow 26, such rotation rotates the suction pad 96 and template holder 82 as indicated by the arrow 94 because they are rotatably supported by the bearing 90. Additionally, several stacked layers of fabric 12 can be accurately clamped for a reliable and simultaneous cutting of several layers of fabric 12 with no problem of slippage and subsequent inaccurate cutting of these pieces of fabric.

The present invention provides a unique template clamping apparatus that greatly assists in the making of a quilt.

What is claimed is:

1. A template clamping apparatus for clamping a fabric against a quilt making template, said apparatus comprising:

a base having an upper surface and a lower surface;

a turntable supported by said base, said turntable defining a working surface which is rotatable relative to said base;

a quilt making template removably disposed on said turntable;

an arm rigidly connected to said base, said arm having a first and a second end; and a clamp connected to said second end of said arm such that when said clamp is disposed in a loading disposition thereof, loading of the fabric between said quilt making template and said turntable is permitted and when said clamp is disposed in a clamping disposition thereof, the fabric is clamped between the quilt making template and said turntable such that when said clamp is disposed in said clamping disposition, relative movement between said quilt making template and the fabric is inhibited while permitting the fabric sandwiched between said turntable and said quilt making template to rotate relative to said base so that cutting of the fabric in conformity with said quilt making template is facilitated.

2. A template clamping apparatus as set forth in claim 1 wherein said base is cut from a rigid sheet of material.

3. A template clamping apparatus as set forth in claim 2 wherein said sheet of material is fabricated from a plastics material.

4. A template clamping apparatus as set forth in claim 1 wherein said base includes:

a plurality of spaced support legs.

5. A template clamping apparatus as set forth in claim 1 wherein said turntable includes:

a first portion defining a plurality of spaced recesses;

a plurality of ball bearings in which one of said ball bearings of said plurality of ball bearings is disposed within a respective recess of said plurality of spaced recesses;

a second portion defining at least one concentric track such that each of said ball bearings cooperates with said at least one concentric track such that relative rotation between said first portion and said second portion is permitted.

6. A template clamping apparatus as set forth in claim 1 wherein said turntable is bearingly supported for rotation relative to said base.

7. A template clamping apparatus as set forth in claim 1 wherein said first end of said arm is rigidly anchored to said base.

8. A template clamping apparatus as set forth in claim 7 further including:

a brace having a first and a second extremity, said first extremity of said brace being rigidly secured to said base;

said second extremity of said brace being rigidly secured to said arm between said first end and said second end of said al in.

9. A template clamping apparatus as set forth in claim 1 wherein said arm includes:

a first part which extends upwardly from said base;

a second part which extends from said first part, said second part extending horizontally and spaced relative to said base.

10. A template clamping apparatus for clamping a fabric against a quilt making template, said apparatus comprising:

a base having an upper surface and a lower surface;

a turntable supported by said base, said turntable defining a working surface which is rotatable relative to said base;

an arm rigidly connected to said base, said arm having a first and a second end;

a clamp connected to said second end of said arm such that when said clamp is disposed in a loading disposition thereof, loading of the fabric between the quilt making template and said turntable is permitted and when said clamp is disposed in a clamping disposition thereof, the fabric is clamped between the quilt making template and said turntable such that when said clamp is disposed in said clamping disposition, relative movement between the quilt making template and the fabric is inhibited while permitting the fabric sandwiched between said turntable and the quilt making template to rotate relative to said base so that cutting of the fabric in conformity with the guilt making template is facilitated;

a block connected to said second end of said arm, said block defining a bore;

a lever connected to said block, said lever having a first extremity and a second extremity;

said clamp including:

a rod slidably cooperating with said bore of said block, said rod having a proximal end and a distal end;

said first extremity of said lever is pivotally connected to said proximal end of said rod; and a link having a first end and a second end, said lever being pivotally connected to said first end of said link between said first extremity of said lever and said second extremity of said lever, said second end of said link being pivotally connected to said block, the arrangement being such that when said lever is disposed in a first location thereof, said clamp is disposed in said loading disposition and when said lever is disposed in a second location thereof, said clamp is disposed in said clamping disposition.

11. A template clamping apparatus as set forth in claim 10 further including:

an anchor rigidly secured to said second end of said arm for adjustably securing said block relative to said second end of said arm;

said clamp further including:

a coupling secured to said distal end of said rod, said coupling defining a recess;

a bearing cooperating with and at least partially disposed within said recess of said coupling;

a template holder supported by said bearing such that relative rotation between said template holder and said distal end of said rod is permitted so that when said clamp is in said clamping disposition thereof, rotation of said turntable rotates the fabric, the template and said template holder to facilitate cutting the fabric along a pattern defined by the template.

12. A template clamping apparatus as set forth in claim 11 wherein said template holder includes:

a suction pad.

13. A template clamping apparatus for clamping a fabric against a quilt making template, said apparatus comprising:

a base having an upper surface and a lower surface;

a turntable supported by said base, said turntable defining a working surface which is rotatable relative to said base;

an arm rigidly connected to said base, said arm having a first and a second end;

a clamp connected to said second end of said arm such that when said clamp is disposed in a loading disposition thereof, loading of the fabric between the quilt making template and said turntable is permitted and when said clamp is disposed in a clamping disposition thereof, the fabric is clamped between the quilt making template and said turntable such that when said clamp is disposed in said clamping disposition, relative movement between the quilt making template and the fabric is inhibited while permitting the fabric sandwiched between said turntable and the quilt making template to rotate relative to said base so that cutting of the fabric in conformity with the quilt making template is facilitated; and a cutting sheet disposed between the fabric and said turntable for protecting said turntable during cutting of the fabric.

14. A template clamping apparatus for clamping a fabric against a quilt making template, said apparatus comprising:

a base having an upper surface and a lower surface;

a turntable supported by said base, said turntable defining a working surface which is rotatable relative to said base;

an arm rigidly connected to said base, said aim having a first and a second end; and a clamp connected to said second end of said arm such that when said clamp is disposed in a loading disposition thereof, loading of the fabric between the quilt making template and said turntable is permitted and when said clamp is disposed in a clamping disposition thereof, the fabric is clamped between the quilt making template and said turntable such that relative movement between the quilt making template and the fabric is inhibited while permitting the fabric sandwiched between the turntable and the quilt making template to rotate relative to said base so that cutting of the fabric in conformity with the quilt making template is facilitated;

a block connected to said second end of said arm, said block defining a bore;

a lever connected to said block, said lever having a first extremity and a second extremity;

said clamp including:

a rod slidably cooperating with said bore of said block, said rod having a proximal end and a distal end;

said first extremity of said lever being pivotally connected to said proximal end of said rod;

a link having a first end and a second end, said lever being pivotally connected to said first end of said link between said first extremity of said lever and said second extremity of said lever, said second end of said link being pivotally connected to said block, the arrangement being such that when said lever is disposed in a first location thereof, said clamp is disposed in said loading disposition and when said lever is disposed in a second location thereof, said clamp is disposed in said clamping disposition;

an anchor rigidly secured to said second end of said arm for adjustably securing said block relative to said second end of said arm;

said clamp further including:

a coupling secured to said distal end of said rod, said coupling defining a recess;

a bearing cooperating with and at least partially disposed within said recess of said coupling; and a template holder supported by said bearing such that relative rotation between said template holder and said distal end of said rod is permitted so that when said clamp is in said clamping disposition thereof, rotation of said turntable rotates the fabric, the template and said template holder to facilitate cutting the fabric along a pattern defined by the template.

15. A template clamping apparatus for clamping a fabric against a quilt making template, said apparatus comprising:

a base having an upper surface and a lower surface;

a turntable supported by said base, said turntable defining a working surface which is rotatable relative to said base;

an arm rigidly connected to said base, said arm having a first and a second end;

a clamp connected to said second end of said arm such that when said clamp is disposed in a loading disposition thereof, loading of the fabric between the quilt making template and said turntable is permitted and when said clamp is disposed in a clamping disposition thereof, the fabric is clamped between the quilt making template and said turntable such that relative movement between the quilt making template and the fabric is inhibited while permitting the fabric sandwiched between the turntable and the quilt making template to rotate relative to said base so that cutting of the fabric in conformity with the quilt making template is facilitated;

said base is cut from a rigid sheet of material;

said sheet of material is fabricated from a plastics material;

said base includes:

a plurality of spaced support legs;

said turntable includes:

a first portion defining a plurality of spaced recesses;

a plurality of ball bearings in which a ball bearing of said plurality of ball bearings is disposed within each of said spaced recesses;

a second portion defining at least one concentric track such that each one of said ball hearings cooperates with said at least one concentric track such that relative rotation between said first portion and said second portion is permitted;

said turntable is bearingly supported for rotation relative to said base;

said first end of said arm is rigidly anchored to said base;

a brace having a first and a second extremity, said first extremity of said brace being rigidly secured to said base;

said second extremity of said brace being rigidly secured to said arm between said first end and said second end of said arm;

said arm includes:

a first part which extends upwardly from said base;

a second part which extends from said first part, said second part extending horizontally and spaced relative to said base;

a block connected to said second end of said arm, said block defining a bore;

a lever connected to said block, said lever having a first extremity' and a second extremity;

said clamp including:

a rod slidably cooperating with said bore of said block, said rod having a proximal end and a distal end;

said first extremity of said lever being pivotally connected to said proximal end of said rod;

a link having a first end and a second end, said lever being pivotally connected to said first end of said link between said first extremity of said lever and said second extremity of said lever, said second end of said link being pivotally connected to said block, the arrangement being such that when said lever is disposed in a first location thereof, said clamp is disposed in said loading disposition and when said lever is disposed in a second location thereof, said clamp is disposed in said clamping disposition;

an anchor rigidly secured to said second end of said arm for adjustably securing said block relative to said second end of said arm;

said clamp further including:

a coupling secured to said distal end of said rod, said coupling defining a recess;

a bearing cooperating with and at least partially disposed within said recess of said coupling;

a template holder supported by said bearing such that relative rotation between said template holder and said distal end of said rod is permitted so that when said clamp is in said clamping disposition thereof, rotation of said turntable rotates the fabric, the template and said template holder to facilitate cutting the fabric along a pattern defined by the template;

said template holder including:

a suction pad; and a cutting sheet disposed between the fabric and said turntable for protecting said turntable during cutting of the fabric.

* * * * *